US011295715B2

(12) United States Patent
Katz et al.

(10) Patent No.: US 11,295,715 B2
(45) Date of Patent: Apr. 5, 2022

(54) TECHNIQUES FOR CONTROLLING THE EXPRESSIVE BEHAVIOR OF VIRTUAL INSTRUMENTS AND RELATED SYSTEMS AND METHODS

(71) Applicant: Symphonova, Ltd., London (GB)

(72) Inventors: Shelley Katz, Bexhill on Sea (GB); Goran Tchubrilo, London (GB)

(73) Assignee: Symphonova, Ltd., London (GB)

( * ) Notice: Subject to any disclaimer, the term of this patent is extended or adjusted under 35 U.S.C. 154(b) by 85 days.

(21) Appl. No.: 16/650,535

(22) PCT Filed: Sep. 25, 2018

(86) PCT No.: PCT/EP2018/025245
§ 371 (c)(1),
(2) Date: Mar. 25, 2020

(87) PCT Pub. No.: WO2019/057343
PCT Pub. Date: Mar. 28, 2019

(65) Prior Publication Data

US 2020/0279544 A1 Sep. 3, 2020

Related U.S. Application Data

(60) Provisional application No. 62/562,870, filed on Sep. 25, 2017.

(51) Int. Cl.
*G10H 1/02* (2006.01)
*G10H 1/00* (2006.01)
*G10H 1/46* (2006.01)

(52) U.S. Cl.
CPC ..... *G10H 1/02* (2013.01); *G10H 1/0008* (2013.01); *G10H 1/46* (2013.01); *G10H 1/0066* (2013.01);
(Continued)

(58) Field of Classification Search
CPC ..... G10H 1/02; G10H 1/0008; G10H 1/46; G10H 1/0066; G10H 2210/155;
(Continued)

(56) References Cited

U.S. PATENT DOCUMENTS 7,915,514 B1 * 3/2011 Shrem ..... G10H 1/02 84/645
10,643,593 B1 * 5/2020 Kolen ..... G10H 1/0025
(Continued)

FOREIGN PATENT DOCUMENTS

EP 2 115 732 A2 11/2009

OTHER PUBLICATIONS

International Search Report and Written Opinion for International Application No. PCT/EP2018/025245, dated Jan. 2, 2019.
(Continued)

*Primary Examiner* — Jeffrey Donels
(74) *Attorney, Agent, or Firm* — Wolf, Greenfield & Sacks, P.C.

(57) ABSTRACT

Techniques for automatically controlling the expressive behavior of a virtual musical instrument by analyzing an audio recording of a live musician are provided. In some embodiments, an audio recording may be analyzed at various points along the timeline of the recording to derive corresponding values of a parameter that is in some way representative of the musical expression of the live musician. Values of control parameters that control one or more aspects of the audio playback of a virtual instrument may then be generated based on the determined values of the expression parameter. Values of control parameters may be provided to a sample library to control how a digital score selects and/or plays back samples from the library, and/or values of the control parameters may be stored with the digital score for subsequent playback.

20 Claims, 10 Drawing Sheets

(52) U.S. Cl.
CPC . *G10H 2210/155* (2013.01); *G10H 2210/381* (2013.01); *G10H 2220/201* (2013.01); *G10H 2240/145* (2013.01)

(58) Field of Classification Search
CPC ..... G10H 2210/381; G10H 2220/201; G10H 2240/145
USPC ..... 84/609
See application file for complete search history.

(56) References Cited

U.S. PATENT DOCUMENTS

| | | | | |
|---|---|---|---|---|
| 2003/0188625 | A1 | 10/2003 | Tucmandl | |
| 2006/0090632 | A1 | 5/2006 | Ludwig | |
| 2008/0314228 | A1 | 12/2008 | Dreyfuss et al. | |
| 2009/0114079 | A1* | 5/2009 | Egan | G09B 15/023 84/477 R |
| 2015/0013528 | A1* | 1/2015 | Buskies | G10H 1/00 84/611 |
| 2017/0092246 | A1* | 3/2017 | Manjarrez | G10H 1/0008 |
| 2018/0233119 | A1* | 8/2018 | Patti | G10H 1/0058 |

OTHER PUBLICATIONS

International Preliminary Report on Patentability for International Application No. PCT/EP2018/025245, dated Mar. 31, 2020.
Esling et al., ORCHIDS: Abstract and temporal orchestration software. End user documentation. IRCAM. Nov. 1, 2014; 34 pages.

* cited by examiner

TECHNIQUES FOR CONTROLLING THE EXPRESSIVE BEHAVIOR OF VIRTUAL INSTRUMENTS AND RELATED SYSTEMS AND METHODS

CROSS-REFERENCE TO RELATED APPLICATIONS

The present application is a national stage filing under 35 U.S.C. § 371 of international PCT application, PCT/EP2018/025245, filed Sep. 25, 2018, which claims priority under 35 U.S.C. § 119(e) to U.S. Provisional Patent Application No. 62/562,870, filed on Sep. 25, 2017, titled "Music Performance System and Method," the entire contents of each of these applications are hereby incorporated by reference in their entirety.

BACKGROUND

In the music industry, composers or other artists often create synthesized orchestral music, commonly referred to as a "mock up." A mock up is produced by an artist programming a digital score which can be played to produce the sound of multiple instruments. To produce this score, the mock up artist will often program not only the musical notes that the synthesized, or "virtual," instruments are to play, but may also program other musical properties for the notes such as tone (also called timbre), vibrato and loudness.

Mock ups may be utilized in various ways in the music industry. In some cases, a mock up may be produced as a form of musical prototype so that an artist can listen to a musical composition before assembling live musicians to play the same composition. In some cases, a mock up may be played along with live musicians so that the combined sound simulates the sound that would be produced by a greater number of live musicians than are actually present.

SUMMARY

According to some aspects, a computer-implemented method of controlling the expressive behavior of a virtual musical instrument is provided, the method comprising obtaining an audio recording of a live musician playing an instrument, and generating, using at least one processor, at least part of a digital score representing audio of a virtual instrument having dynamic expression based on the audio recording, said generating comprising determining, for a first time position within the audio recording and based on the audio recording, a first value of an expression parameter, wherein the expression parameter is indicative of dynamic expression of the live musician, generating a first value of a control parameter based at least in part on the determined first value of the expression parameter, wherein the control parameter controls one or more aspects of the playback of audio samples for the virtual instrument, determining, for a second time position within the audio recording and based on the audio recording, a second value of the expression parameter, and generating a second value of the control parameter based at least in part on the determined second value of the expression parameter.

According to some embodiments, the method further comprises storing the first value of the control parameter within the digital score at one or more time positions based on the first time position, and storing the second value of the control parameter within the digital score at one or more time positions based on the second time position.

According to some embodiments, the method further comprises generating a first control message for the first time position within the audio recording, the first control message comprising an indication of the control parameter and an indication of the first value of the control parameter, and generating a second control message for the second time position within the audio recording, the second control message comprising an indication of the control parameter and an indication of the second value of the control parameter.

According to some embodiments, the method further comprises providing the first control message and the second control message to a sample library.

According to some embodiments, the method further comprises selecting, by the sample library from a plurality of audio samples, a first audio sample and a first value for at least one playback control of the first audio sample based at least in part on the first control message, and selecting, by the sample library from the plurality of audio samples, a second audio sample and a second value for the at least one playback control, different from the first value, of the second audio sample based at least in part on the second control message.

According to some embodiments, the audio recording of the live musician is obtained as a stream of audio data and the at least part of the digital score is generated in real-time based on the stream of audio data.

According to some embodiments, generating the at least part of the digital score is further based on sensor data generated by the live musician playing the instrument, the sensor data being produced concurrently with the audio recording.

According to some embodiments, determining the first value of an expression parameter comprises determining a peak amplitude of the audio recording at the first time position.

According to some embodiments, determining the first value of an expression parameter comprises determining a predetermined mixture of the peak amplitude of the audio recording at the first time position and a root mean square of the peak amplitude of the audio recording at the first time position.

According to some embodiments, generating the first value of the control parameter based at least in part on the determined first value of the expression parameter comprises scaling the first value of the expression parameter to an integer value within a predetermined range.

According to some embodiments, the predetermined range is between 0 and 127.

According to some embodiments, generating the first value of the expression parameter comprises determining a centroid of a frequency spectrum of the audio recording at the first time position.

According to some embodiments, generating the first value of the expression parameter comprises applying an offset to a measurement of the audio recording, the offset being selected based at least in part on a frequency value of the determined centroid.

According to some aspects, a non-transitory computer-readable medium is provided comprising instructions that, when executed by at least one processor, perform a method of controlling the expressive behavior of a virtual musical instrument, the method comprising obtaining an audio recording of a live musician playing an instrument, and generating, using at least one processor, at least part of a digital score representing audio of a virtual instrument having dynamic expression based on the audio recording, said generating comprising determining, for a first time position within the audio recording and based on the audio recording, a first value of an expression parameter, wherein the expression parameter is indicative of dynamic expression of the live musician, generating a first value of a control parameter based at least in part on the determined first value of the expression parameter, wherein the control parameter controls one or more aspects of the playback of audio samples for the virtual instrument, determining, for a second time position within the audio recording and based on the audio recording, a second value of the expression parameter, and generating a second value of the control parameter based at least in part on the determined second value of the expression parameter.

According to some embodiments, the method further comprises storing the first value of the control parameter within the digital score at one or more time positions based on the first time position, and storing the second value of the control parameter within the digital score at one or more time positions based on the second time position.

According to some embodiments, the method further comprises generating a first control message for the first time position within the audio recording, the first control message comprising an indication of the control parameter and an indication of the first value of the control parameter, and generating a second control message for the second time position within the audio recording, the second control message comprising an indication of the control parameter and an indication of the second value of the control parameter.

According to some embodiments, the method further comprises providing the first control message and the second control message to a sample library.

According to some embodiments, the method further comprises selecting, by the sample library from a plurality of audio samples, a first audio sample and a first value for at least one playback control of the first audio sample based at least in part on the first control message, and selecting, by the sample library from the plurality of audio samples, a second audio sample and a second value for the at least one playback control, different from the first value, of the second audio sample based at least in part on the second control message.

According to some embodiments, the audio recording of the live musician is obtained as a stream of audio data and the at least part of the digital score is generated in real-time based on the stream of audio data.

According to some embodiments, generating the at least part of the digital score is further based on sensor data generated by the live musician playing the instrument, the sensor data being produced concurrently with the audio recording.

The foregoing apparatus and method embodiments may be implemented with any suitable combination of aspects, features, and acts described above or in further detail below. These and other aspects, embodiments, and features of the present teachings can be more fully understood from the following description in conjunction with the accompanying drawings.

BRIEF DESCRIPTION OF DRAWINGS

Various aspects and embodiments will be described with reference to the following figures. It should be appreciated that the figures are not necessarily drawn to scale. In the drawings, each identical or nearly identical component that is illustrated in various figures is represented by a like numeral. For purposes of clarity, not every component may be labeled in every drawing.

DETAILED DESCRIPTION

Figure 1:
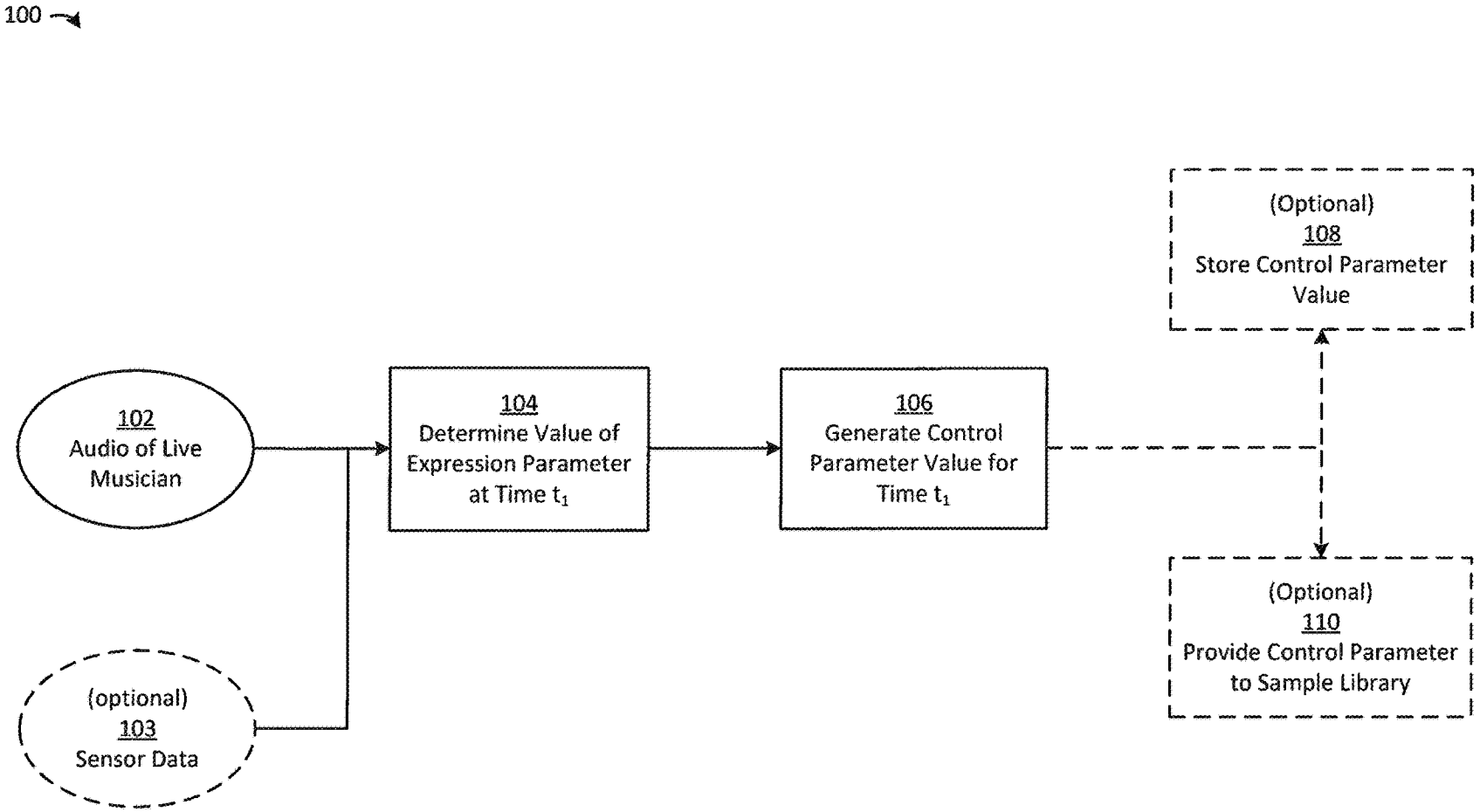
FIG. 1 is a schematic diagram of a method for automatically controlling the expressive behavior of a virtual musical instrument by analyzing an audio recording of a live musician, according to some embodiments.

While advances in the production of large, configurable sample libraries of live instruments have dramatically increased the quality of mock ups, they are typically inferior to the sound of live musicians. One reason for the difference in quality is that there are many nuances to a live musical performance that are difficult and/or time-consuming for a mock up artist to represent in a digital score. In some cases, most particularly in classical music, these nuances may be extremely subtle and either extremely difficult or impossible for a mock up artist to simulate in a digital score. Capturing nuances in a mock up to produce digital music that convincingly simulates an orchestral score therefore requires a great deal of expertise and time on the part of the mock up artist. While in some cases a mock up may be considered a suitable substitute for a recording of live musicians, such mock ups still require a great deal of expense to produce due to the aforementioned skill and time required to produce them.

As an illustrative example, a symphony orchestra comprises several sections of instruments categorized as strings, woodwinds, brass, percussion and others. These sections may be further grouped; for instance, a strings section commonly includes one or more groups of 1st violins (V1), 2nd violins (V2), violas (Vla), cellos (Vc), and/or Contra Bass or Double Bass (DB). Large orchestras may have many players in each of these groups. For instance, it is not uncommon for an orchestra to include 16 V1 or even 24 V1. In the orchestral scores from and after Beethoven, it is common for each individual group to be further divided into subgroups. These are referred to as "divisi" in the score. In some composers, such as Richard Strauss or Mahler, there may be four divisi, which—by way of example—are referred to here as V1-1, V1-2, V1-3 and V1-4. Although not a rule, it is common for the divisi to be equal in size; in a group of 16 V1, four divisi would commonly be four musicians in each group.

A skilled performer may vary numerous aspects of expression of their instrument, each of which contribute to the sound of the instrument during performance. Examples of such expression may include: i) loudness (which may include the attack of a note or chord, the sustain portion, and/or the decay portion); ii) timbre; iii) vibrato (e.g., rate, overall width, and/or extent above or below a given pitch); iv) instrument-specific modifiers (e.g., the sustain or 'una corda' pedals on a piano, flutter-tongue techniques on wind instruments, positioning the bow near to the bridge or above the finger-board on a stringed instrument, etc.); and v) the real-time modification of their performance to enhance, contrast, lead or respond to other players in the ensemble and/or the conductor (if there is one). Since the nature of these expressions differs based on both the instrument and the particular piece of music being played, there are a huge number of details to be considered when programming a digital score for even a single instrument. When that task is compounded by the large number of musicians in an orchestra with different sections, groups and divisi as described above, programming a digital score for an entire orchestra becomes a monumental effort.

The inventors have recognized and appreciated techniques for automatically controlling the expressive behavior of a virtual musical instrument by analyzing an audio recording of a live musician. In particular, an audio recording may be analyzed at various points along the timeline of the recording to derive corresponding values of a parameter that is in some way representative of the musical expression of the live musician. For instance, values of an expression parameter that is a measure of the timbre of an instrument may be determined for points along the timeline of the recording. The time points for analysis may in some cases be effectively continuous in nature by analyzing the audio recording in real-time; that is, the audio recording may be presented as streaming audio.

Values of control parameters that control one or more aspects of the audio playback of a virtual instrument may then be generated based on the determined values of the expression parameter. For instance, in a Musical Instrument Digital Interface (MIDI)-based system, a value for the velocity cross-fade MIDI parameter may be controlled based on an expression parameter that is a measure of the timbre of an instrument. Values of control parameters may, in some embodiments, be provided to a sample library to control how the digital score selects and/or plays back samples from the library. In some embodiments, values of the control parameters may be stored with the digital score for subsequent playback.

According to some embodiments, controlling the expressive behavior of a virtual musical instrument may comprise analyzing an audio recording of a live musician obtained through a so-called "close mic" setup. A close mic setup refers to a microphone that is placed close to the sound source to maximize how much of the captured sound is from the source and not from other possible sources of sound in the environment. The inventors have recognized and appreciated that the techniques for controlling the expressive behavior of a virtual musical instrument may be particularly effective when said control is based on an audio recording of a live musician that is both dry (i.e., exhibits low reverberance) and includes very little or no sound other than that produced by the instrument played by the musician. As such, a close mic setup may be preferred to produce the audio recording. In some embodiments, an audio recording of a live musician, based on which the expressive behavior of a virtual instrument may be controlled, may exhibit at least a 20 dB difference in volume between the instrument being played by the live musician and any other sound captured by the recording. In some embodiments, a close mic setup may comprise placement of a microphone inside some part of a musical instrument, such as within the interior of a violin or a piano. In some embodiments, a close mic setup may comprise a contact microphone, which is a microphone that transduces vibrations of solid objects into audio signals, placed on the interior or exterior of a musical instrument and that may be mechanically coupled to the instrument.

As discussed above, an audio recording may be analyzed at various points along the timeline of the recording to derive corresponding values of a parameter that is in some way representative of the musical expression of the live musician. Such a parameter is referred to herein as an "expression parameter," and may be derived from any one or more aspects of the audio recording. In some embodiments, values of an expression parameter may be determined based on the peak amplitude of the audio recording; since the peak will in general vary during an audio recording of a live musician, the values of the expression parameter thus derived may also vary during the timeline of the recording. Irrespective of how values of an expression parameter are determined (examples are provided below), the values so-determined represent some aspect of the musical expression of the recording of the live musician that are associated with corresponding times in the audio recording.

According to some embodiments, values of one or more control parameters may be generated based on determined values of an expression parameter. As discussed above, a control parameter is a parameter that controls one or more aspects of audio playback of a virtual instrument. In some cases, a value of a control parameter may be represented as a value in a control change MIDI message, although this is not a requirement as the techniques described herein are not so limited. Times during the audio recording associated with respective values of the expression parameter may also be associated with respective values of a control parameter generated based on the values of the expression parameter.

According to some embodiments, a value of a control parameter may be generated based on a determined value of an expression parameter by transforming the expression parameter value to the control parameter value according to a transform function associated with the expression parameter and the control parameter. Values for different control parameters may be generated from the same expression parameter value by transforming the expression parameter values with different transform functions. In some embodiments, a transform function may produce values of the control parameter within a predetermined range. For instance, when a control parameter is a MIDI parameter, values of the control parameter produced by the transform function may be integers between 0 and 127, irrespective of the value of the expression parameter from which the control parameter value is generated. As such, a transform function may comprise a scaling factor to produce control parameter values in a desired range (which are not limited to the 0-127 example above).

According to some embodiments, the above-described techniques may be embodied in a sequencer, being hardware, software, or a combination of both hardware and software. The techniques may be employed as built-in functionality of the sequencer and/or as an optional component of a sequencer (such as a so-called "plug-in"). One or more processors executing the sequencer may thereby execute steps of generating a control parameter value, generating an expression parameter value based on an audio recording, etc. In some embodiments, control parameter values generated by a sequencer may be stored as events along a timeline by the sequencer (e.g., within one or more tracks) to later produce control messages based on the stored value. Such events stored along the timeline may be placed at times based on a corresponding time within the audio recording from which control parameter values of the event were generated, which may include, but is not limited to, being placed at the same time as the time in the audio recording.

According to some embodiments, the above-described techniques may be applied in real-time, which may encompass analysis of a streaming audio recording of a live musician to generate expression parameter values and/or control parameter values dynamically. Such a real-time process may, in some embodiments, be performed within a sequencer. For instance, a sequencer may play back a saved audio recording of the live musician and in real-time analyze the playing stream of audio to generate expression parameter values and/or control parameter values. Dynamically generated control messages containing the generated control parameter values may in some cases be produced and supplied to a sample library or other program for generating the sound of a virtual instrument. In some embodiments, a real-time process may occur during live performance in which live audio is captured from a musician via one or more microphones and analyzed to dynamically generate expression parameter values and/or control parameter values.

Following below are more detailed descriptions of various concepts related to, and embodiments of, techniques for automatically controlling the expressive behavior of a virtual musical instrument by analyzing an audio recording of a live musician. It should be appreciated that various aspects described herein may be implemented in any of numerous ways. Examples of specific implementations are provided herein for illustrative purposes only. In addition, the various aspects described in the embodiments below may be used alone or in any combination, and are not limited to the combinations explicitly described herein.

FIG. 1 is a schematic diagram of a method for automatically controlling the expressive behavior of a virtual musical instrument by analyzing an audio recording of a live musician, according to some embodiments. Method 100 may be performed by any suitable computing system or systems, such as by a sequencer program (which may include installable components of the sequencer, referred to as plug-ins), and may be performed by any suitable combination of hardware and/or software. Method 100 is configured to determine, based on audio of a live musician playing an instrument (and, optionally, based on motion sensor data of the live musician), control parameters that define dynamic control of expressive behavior of a virtual instrument.

Method 100 generates values for one or more control parameters for control of one or more virtual instruments based on audio of a live musician 102. In some embodiments, the audio 102 may be obtained by the system performing method 100 in real-time. For instance, audio 102 may be played back as a streaming audio file, or audio 102 may represent live audio being performed and captured by one or more microphones. In some embodiments, audio 102 may comprise one or more data files representing the recording of the live musician, which are accessed and read by the system performing method 100.

Optionally in method 100, additional data regarding the live musician may be obtained from one or more sensors and analyzed in addition to the audio 102 to generate the values of the control parameter(s). Since musical expression may be expressed during performance not only through the sound produced by a musician but also through their physical movement, behavior and/or physiology, sensors that capture aspects of these additional expressions may also provide insight into how to control the behavior of a virtual instrument. Sensor data 103 optionally provided may comprise any one or more of: visual data (including images and/or video of one or more musicians, which may include images and/or video from multiple perspectives of the one or more musicians); accelerometer or other motion sensor data (e.g., worn on moving portions of the musician's body such as fingers, hands, wrists, etc. or combinations thereof); measurements of skin conduction at one or more locations on the musician's body; heart rate measurements; and/or oxygen uptake measurements.

In act 104, a value of an expression parameter is determined for a time $t_1$ during the provided audio of the live musician 102. In some embodiments when the audio 102 is input in real-time, the time $t_1$ may simply be a time during playback at which the value of the expression parameter is determined, rather than a numerical time value selected from a timeline. As discussed above, an expression parameter is a parameter that is in some way representative of the musical expression of the live musician. A value of an expression parameter may be calculated according to a predetermined formula or process based on the audio 102 (and optionally, on sensor data 103) so that the same formula or process is followed for each time point in the audio 102 to produce different values of the same expression parameter.

As a simple example, the peak volume level of the audio 102 as it changes over time may provide some insight into how musical expression is changing over time. In particular, the way that an instrument sounds at a comparatively high volume is generally not simply a louder version of how the instrument sounds at a comparatively low volume because the timbre or other aspects of the instrument's sound may change as the musician plays louder or softer. An expression parameter that is simply a measure of the peak of an audio recording may therefore represent an aspect of the musical expression of the recorded musician.

Processes for determining values of an expression parameter may be determined by a music professional based on their knowledge of how the sound of an instrument changes its musical expression. As such, determined processes may be specific to a particular instrument. Examples of determining values of an expression parameter are discussed below in relation to FIGS. 2A-2D.

According to some embodiments, a value of an expression parameter determined for a time $t_1$ may be based on audio of the live musician during a time window ending at, or otherwise including, the time $t_1$. In some cases, determination of an expression parameter value may be based on non-instantaneous properties of the audio such as an average peak, an average frequency, or a variance of the peak. As a result, determination of the value of an expression parameter that is based on such properties may in some embodiments comprise analysis of a period of the audio to determine a value of the property during this period. In some embodiments, the expression parameter value may be based upon a moving average of one or more properties of the audio 102. According to some embodiments, determining a value of an expression parameter may be based upon one or more of the following properties of a period of the audio recording: a width or spread of a frequency spectrum, a measurement of balance across the frequency spectrum (e.g., by considering an amount of energy within different frequency bands), a measurement of continuous energy difference, a measurement of energy slope, a measurement of micro pitch-tuning, and/or a ratio of energy between attack, sustain and decay.

In act 106, a control parameter value for the time $t_1$ is determined based on the value for the expression parameter determined in act 104. While the determined values of the expression parameter may be representative of musical expression, the values may not be directly suitable for control of a virtual instrument, either because the control values of the virtual instrument may not scale linearly with the values of the expression parameter, and/or because the virtual instrument has constraints on the values that can be accepted for control. For instance, where the control parameter is to be used to control a MIDI parameter for a virtual instrument, the acceptable range of control parameter values consists of the integers from 0 to 127.

According to some embodiments, act 106 may comprise scaling and/or quantization of the determined value of the expression parameter to produce the control parameter value. Scaling factors may include both linear or non-linear scaling factors and may be selected to produce a desired range of control parameter values (which need not represent the full available range of control values). For instance, a range of values of an expression parameter may be linearly scaled to integers between 10 and 40 to control a MIDI value when it is desirable that the MIDI control extend to a subset of the full range of available control values. According to some embodiments, scaling factors may be applied to the expression parameter based on a predetermined range of possible values of the expression parameter.

In method 100, a determined value of the control parameter in act 106 may be optionally stored in act 108 and/or may be provided to a sample library in act 110. Producing the sound of a virtual instrument based on the determined control parameter may thereby comprise either or both of saving information sufficient to later produce such sound (act 108) and/or providing the information to a sample library so that the sample library can produce the sound.

According to some embodiments, act 108 may comprise storing events in a sequencer so that later playback of the audio of the live musician 102 may simultaneously produce sound of a virtual instrument as controlled by the stored events. In some cases, the sequencer may comprise sequences of notes to be played back through a sample library to produce the sound of the virtual instrument so that the stored events are executed during playback contemporaneously, but separate from, the playback of the notes. In some embodiments, sequencer data to produce the sound of several virtual instruments may be produced for a single audio recording, thereby effective producing a chorus of instruments.

According to some embodiments, act 110 may comprise providing a control message to a sample library that, at least in part, may subsequently dictate which sample the library selects for playback and/or how said selected sample is played back. Said control may dictate such acts for multiple notes in some cases. For instance, where a sample library is being provided commands to play various notes of an instrument, a control message may cause the setting of a control value by the sample library that affects subsequent playback of notes and this setting may persist until another control message is received that causes a change in the setting. An illustrative example of a suitable sample library to which the control parameter may be provided in act 110 is the Vienna Symphonic Library.

Figure 2A:
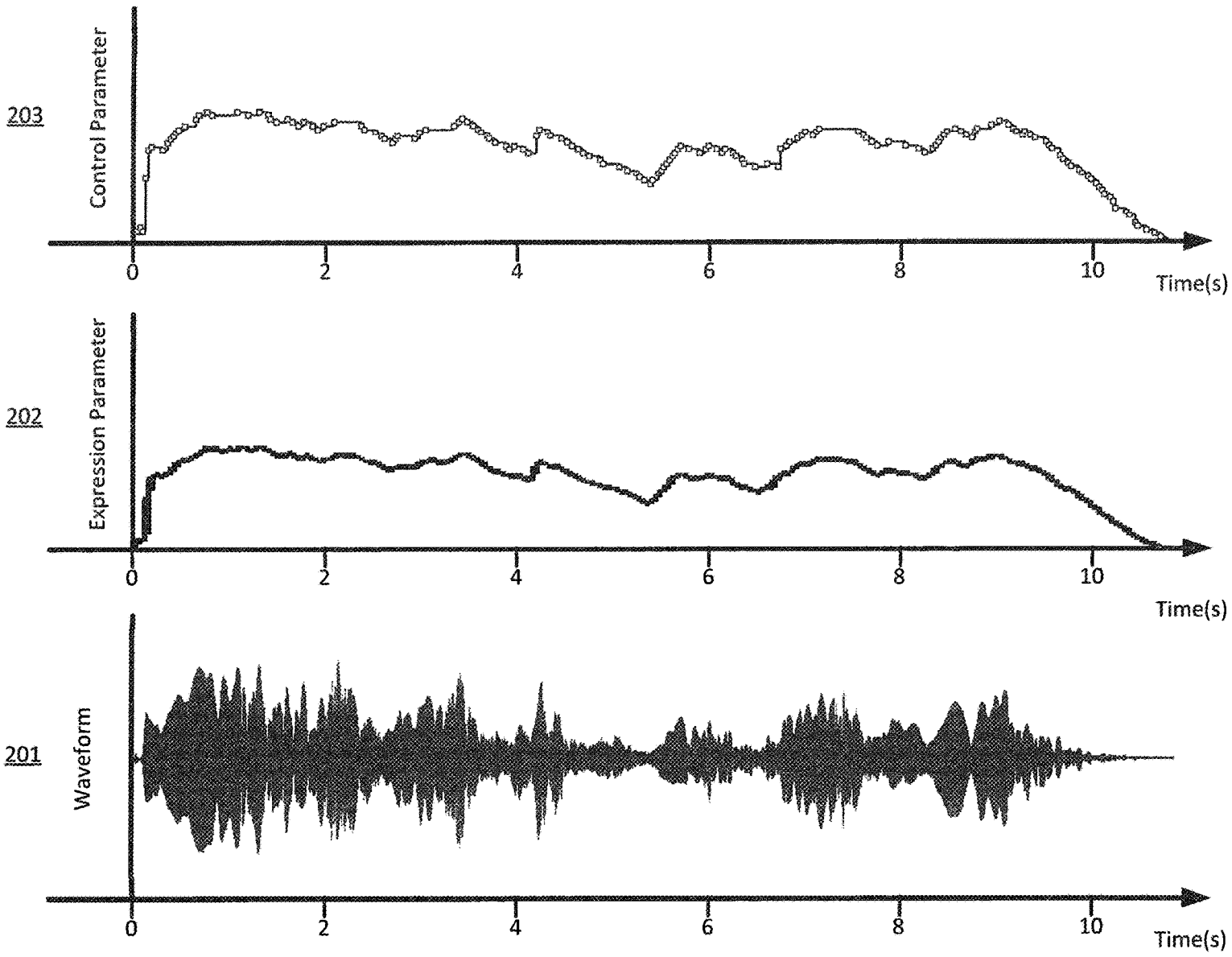
FIG. 2A depicts first illustrative expression parameter and control parameter values determined for an illustrative audio recording of a live musician, according to some embodiments.
Figure 2B:
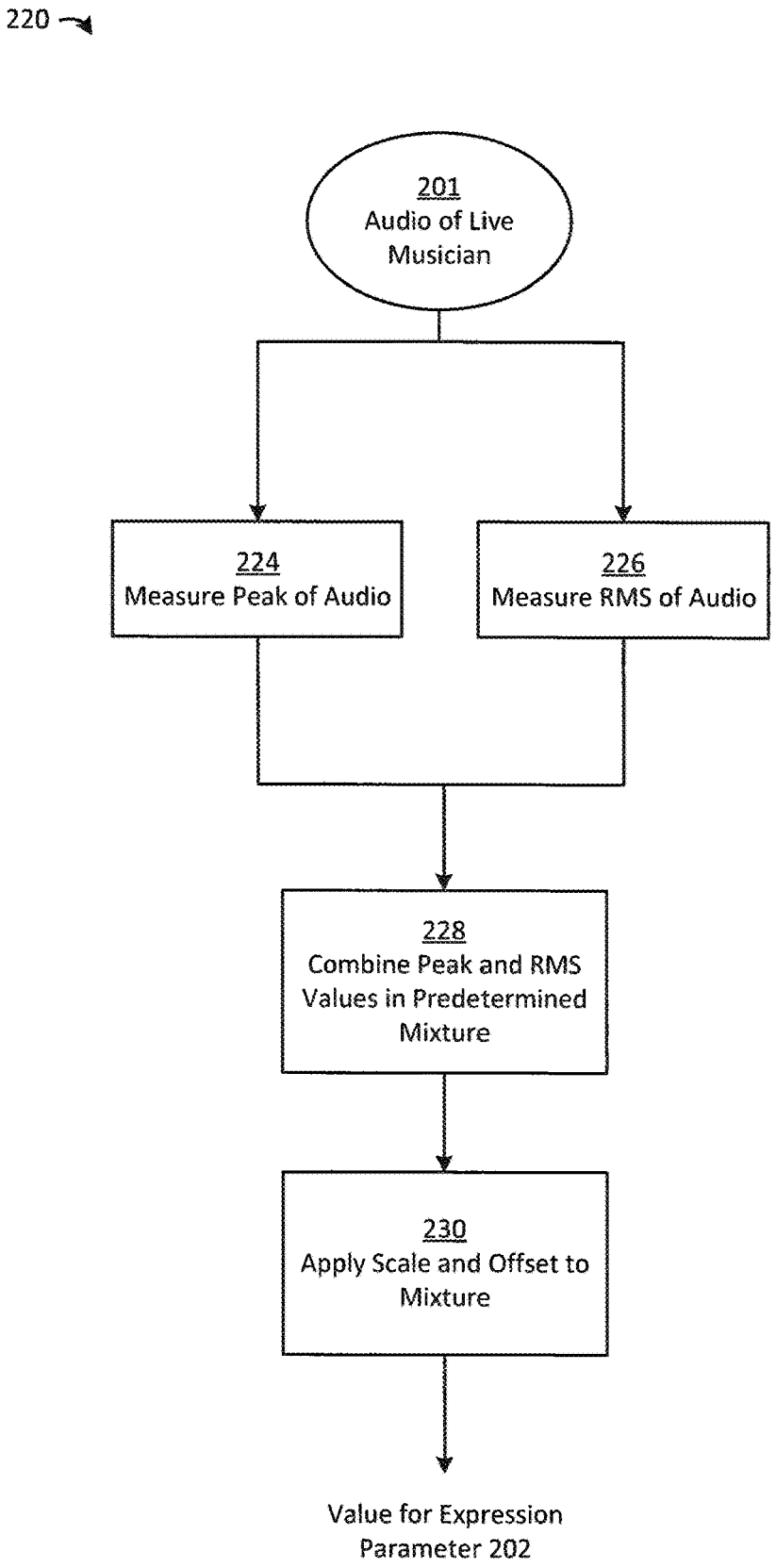
FIG. 2B is a flowchart of a method of determining the values of the expression parameter of FIG. 2A, according to some embodiments.
Figure 2C:
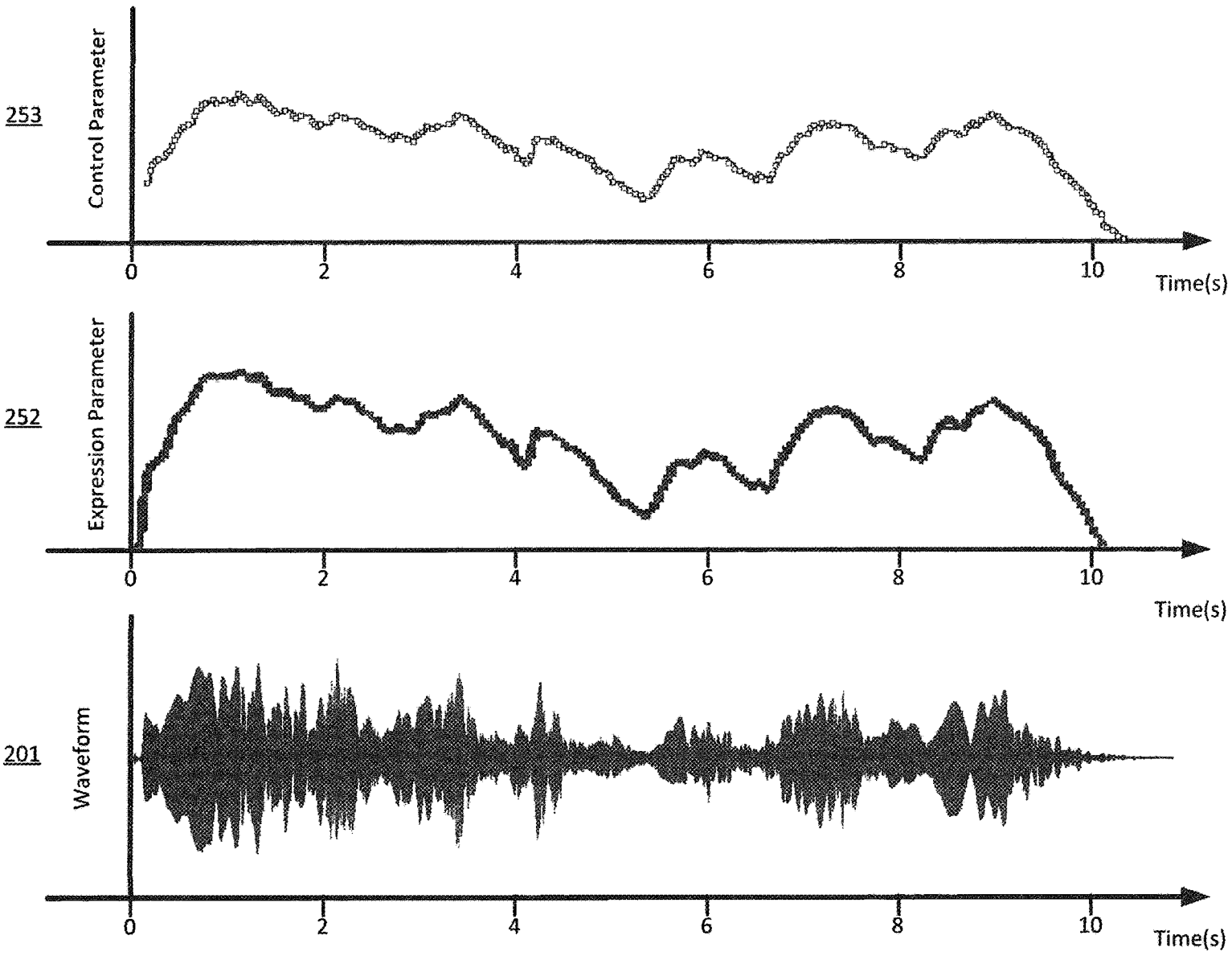
FIG. 2C depicts second illustrative expression parameter and control parameter values determined for the illustrative audio recording of FIG. 2A, according to some embodiments.
Figure 2D:
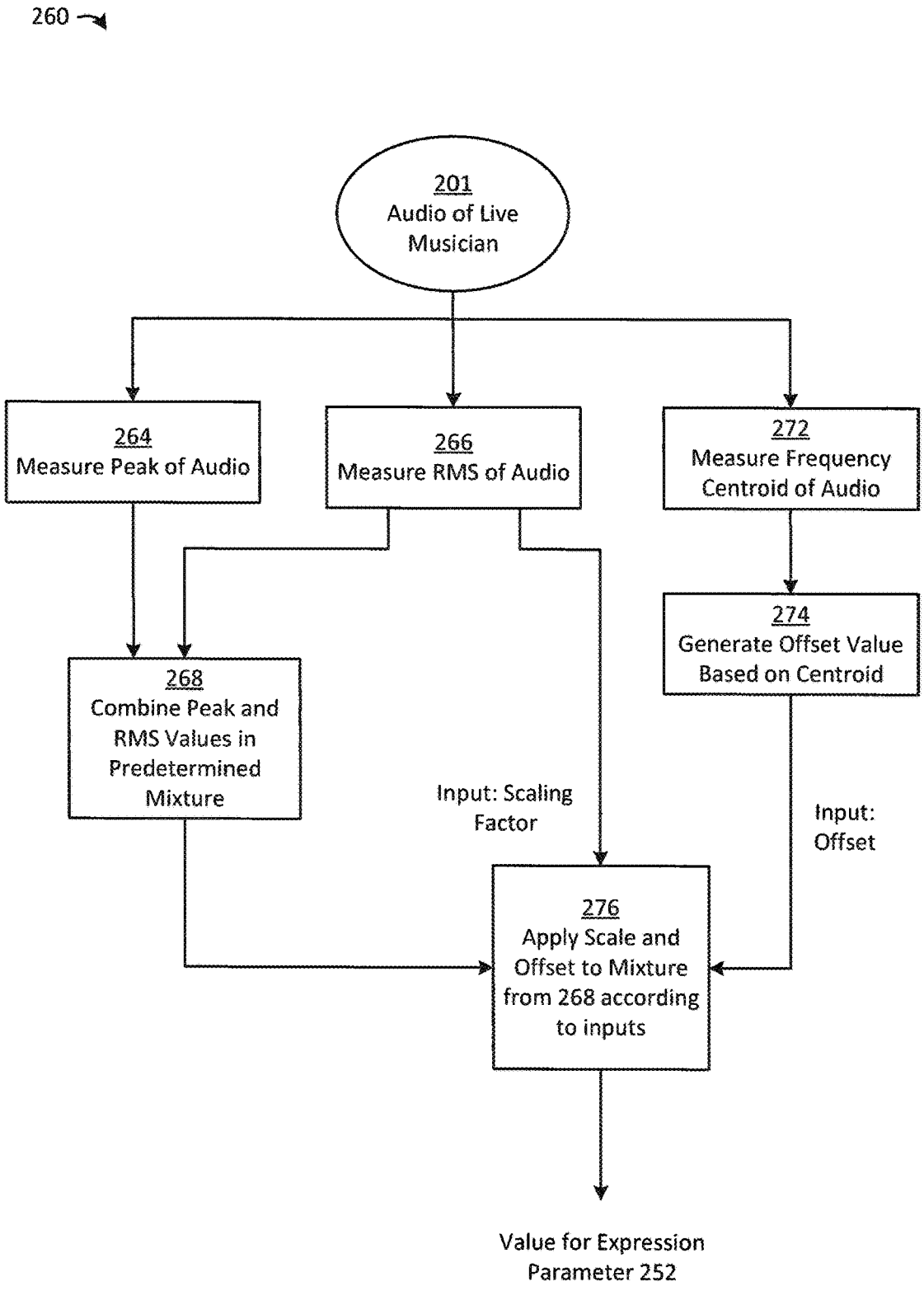
FIG. 2D is a flowchart of a method of determining the values of the expression parameter of FIG. 2C, according to some embodiments.

FIGS. 2A-2D provide an illustrative example of determining values of two different expression parameters and corresponding control parameters for the same audio recording, according to some embodiments. FIG. 2A illustrates determined values of an expression parameter for an audio recording and corresponding determined values of a control parameter, and FIG. 2B is a flowchart of a process of determining the values of the expression parameter of FIG. 2A from the audio recording. FIGS. 2C and 2D depict the same information for a different expression parameter and a different control parameter.

In the example of FIG. 2A, an audio recording, represented as waveform 201, is depicted along a timeline running horizontally. Determined values of an expression parameter 202 are depicted along the same timeline with an arbitrary vertical scale. In this example, values of the expression parameter 202 are determined based on the peak of the waveform (the maximum level of the waveform) in addition to the root mean square (RMS) of the waveform. Unlike a sine wave, the RMS of a complex waveform is not simply proportional to the amplitude of the waveform. This process of determining the values 202 is shown in FIG. 2B and discussed below. Values of a control parameter 203 in the example of FIG. 2A are determined by linearly scaling the values of the expression parameter 202 to a desired range and by quantizing the resulting scaled values to the nearest integer. The values of the control parameter 203 in the example of FIG. 2A are represented by squares that indicate where the value of the control parameter changes, with horizontal lines extending after each change until the next change is encountered.

It may be seen in FIG. 2A that the values of the expression parameter and control parameter follow the amplitude of the waveform 201 to some extent but do not feature the exhibited rapid changes in amplitude that can be seen in the waveform. This "smoothing" of the peak values is a result of combining the peak and RMS values of the waveform to produce the values of the expression parameter 202.

FIG. 2B illustrates the process of determining values for the expression parameter 202 based on the audio waveform 201, according to some embodiments. The process 220 may be performed at a plurality of time steps of the audio waveform 201; in this manner the process 220 may represent an example of at least part of act 104 in FIG. 1.

In the example of FIG. 2B, a peak of the audio 201 is measured in act 224. Measurement of the peak value may in some embodiments be controlled by settings such as attack (the extent to which the peak measurement reacts to signal increases), hold (the extent to which the peak measurement may hold its position even when the level of the signal is decreasing) and/or release (the extent to which the peak measurement reacts to signal decreases). In the example of FIG. 2B, a RMS value of the audio 201 is measured in act 226. Measurement of the RMS value may in some embodiments be controlled by a time window setting that dictates a time window over which the RMS will be calculated. While process 220 may in some cases represent a process used to determine values of expression parameters of different instruments from different audio sources, it may be that control values such as attack, hold, release and/or an RMS time window may vary between implementations for different instruments.

In act 228, the measured peak and RMS values are combined to produce a single value. The peak and RMS values may be combined in predetermined relative amounts (e.g., 40% peak and 60% RMS). The resulting combined value is scaled and offset in act 230 to produce a value of the expression parameter 202. Scaling and offset may be beneficial to produce values of the expression parameter over a desired range.

In the example of FIG. 2C, determined values of a different expression parameter 252 are depicted along the same timeline as the audio waveform 201. In this example, values of the expression parameter 252 are determined based on the peak of the waveform (the maximum level of the waveform) in addition to the root mean square (RMS) of the waveform and a determined centroid of the frequency of the waveform. Values of a control parameter 253 in the example of FIG. 2C are determined by linearly scaling the values of the expression parameter 252 to a desired range and by quantizing the resulting scaled values to the nearest integer.

It may be seen that the values of the expression parameter and control parameter in the example of FIG. 2C follow the amplitude of the waveform 201 to some extent but do not feature the exhibited rapid changes in amplitude that can be seen in the waveform. In addition, however, the values of the expression parameter 252 exhibit greater changes in shape than expression parameter 202 due to a dynamic scaling control process and a dynamic offset control process, as described below.

FIG. 2D illustrates the process of determining values for the expression parameter 252 based on the audio waveform 201, according to some embodiments. The process 260 may be performed at a plurality of time steps of the audio waveform 201; in this manner the process 260 may represent an example of at least part of act 104 in FIG. 1.

In the example of FIG. 2D, a peak of the audio 201 is measured in act 264 and the RMS of the audio 201 is measured in act 266 and is provided as an input scaling factor to act 276. Aspects of acts 264 and 266 may be controlled as discussed above in relation to acts 224 and 226 in FIG. 2B. In act 268, the measured peak and RMS values are combined to produce a single value. The peak and RMS values may be combined in predetermined relative amounts. The resulting combined value, representing a mixture of the peak and RMS values, is output to act 276.

In act 272, a centroid of the frequency spectrum of the audio 201 is determined. Such a determination may comprise, for instance, performing a fast Fourier transform (FFT) upon a time window of the audio 201 to estimate the frequency spectrum of the audio at the time point being analyzed. A centroid of this frequency spectrum may be determined based on this spectrum, and the determined value used to control the production of an offset value in act 274. As a non-limiting example, multiple frequency bands may be defined and each associated with an offset value. The frequency band in which the determined centroid of the audio's frequency spectrum falls may be identified and the band's associated offset value produced as output of step 274.

The scaling factor and offset values determined in acts 266 and 274, respectively, are input to act 276 in which the mixture of peak level and RMS of the audio is scaled and offset as dictated by the corresponding inputs from acts 266 and 272. The scaled and offset mixture of level and RMS is output as the value of the expression parameter 252.

Figure 3A:
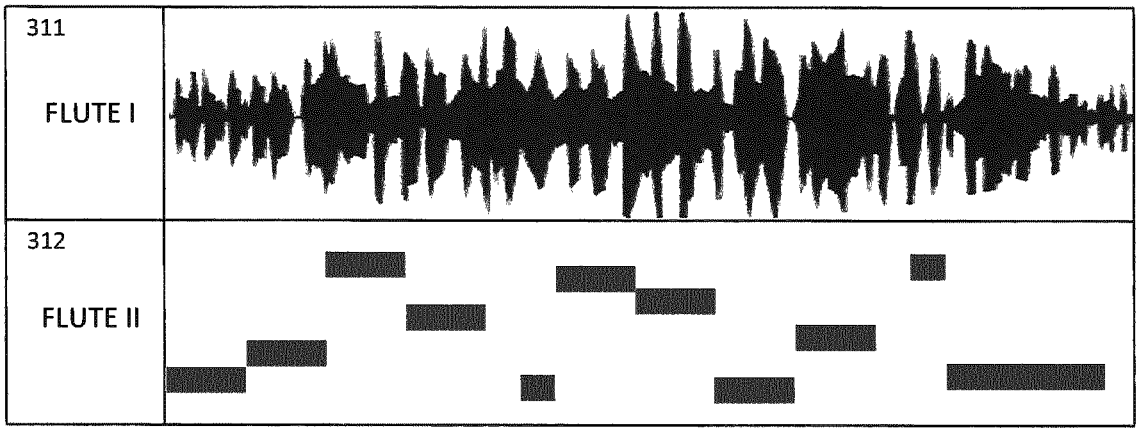
FIGS. 3A-3B depict a process by which control messages are stored as events in a sequencer for control of a virtual musical instrument, according to some embodiments.
Figure 3B:
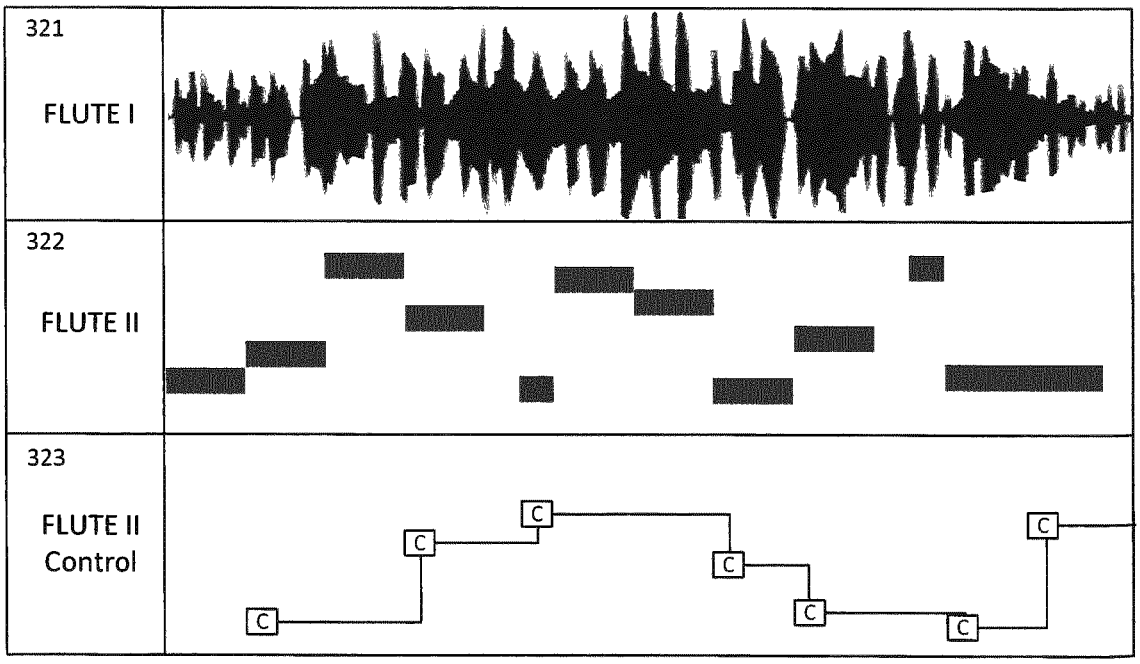

FIGS. 3A-3B depict a process by which control messages are stored as events in a sequencer for control of a virtual musical instrument, according to some embodiments. As discussed above, control messages which comprise one of more values of a control parameter may be generated and, in some embodiments, stored in a sequencer for subsequent execution during playback (e.g., by a sample library). In the example of FIG. 3A, two tracks of a sequencer are illustrated: track 311 which is configured to playback a recording of a flute ("Flute I"), and track 312 which is configured to play back notes of a virtual flute instrument ("Flute II"). In the sequencer, the horizontal axis represents time, so the waveform and notes are played along the timeline from left to right during playback.

According to some embodiments, suitable values of one or more control parameters may be determined for the Flute II virtual instrument based on the recorded audio of the flute in track 311. For instance, method 100 including optional act 108 may be performed to generate values of an expression parameter, and in turn, values of a control parameter based on the audio recording. FIG. 3B depicts the sequencer of FIG. 3A subsequent to control parameters being determined and stored in events placed along the timeline in a new track 323. In the example of FIG. 3B, each control message (which may comprise any number of values of control parameters) is represented by a box containing the letter "C." The lines connecting the control messages may represent values of control parameters which persist between control messages.

Figure 4:
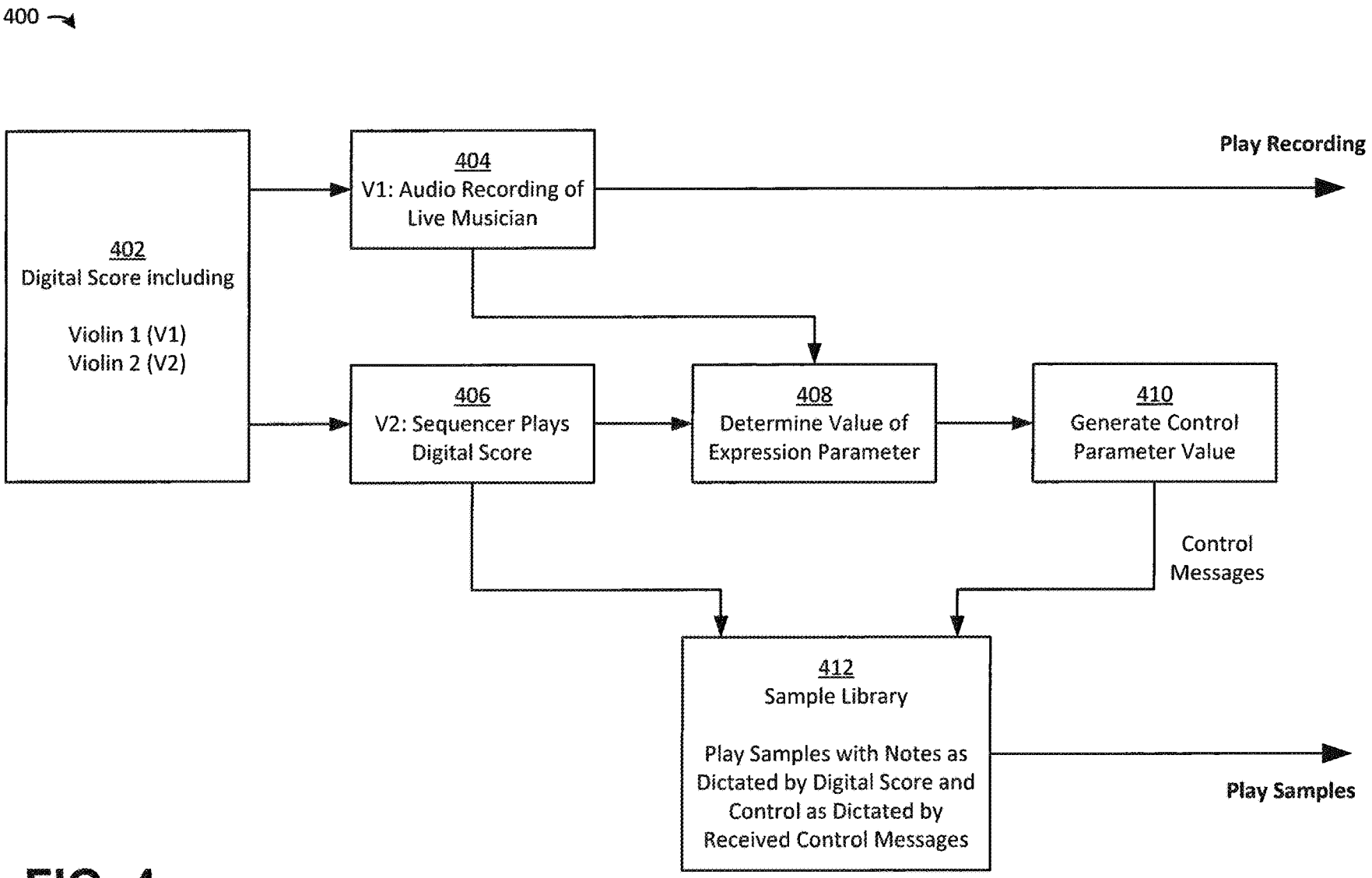
FIG. 4 is a schematic diagram of an illustrative process for producing sound of a live musician in addition to sound of a virtual instrument with expressive behavior controlled by the live musician, according to some embodiments.

FIG. 4 is a schematic diagram of an illustrative process for producing sound of a live musician in addition to sound of a virtual instrument with expressive behavior controlled by the live musician, according to some embodiments. As discussed above, in some embodiments a determination of values of a control parameter may be performed in real-time based on a streaming audio input. Method 400 provides one example in which a digital score is played back to produce streaming audio output whilst also controlling the expressive behavior of sound produced by a virtual instrument based on the streaming audio.

In the example of FIG. 4, a digital score 402 has been previously prepared and includes tracks for two violins, referred to in FIG. 4 as V1 and V2. The sound of violin V1 is to be produced by playing back previously recorded audio of a violinist 404, whereas the sound of violin V2 is produced from a sequencer playing prerecorded notes 406 through a sample library 412. Simultaneously, values for at least one expression parameter is determined based on the audio recording of violin V1 in act 408. In act 410, values of one or more control parameters are determined based on the determined values for the at least one expression parameter, and provided to the sample library to 412 control the expressive behavior of its playback of the notes as dictated by the sequencer.

The result of method 400 is the apparent simultaneous playback of the sound of a live musician and the sound of a virtual instrument. It will be appreciated that more than one virtual instrument could be controlled in the same way based on the same audio recording by extending method 400 to additional sequencer tracks in the digital score, and/or that multiple instances of method 400 could be performed simultaneously to produce sound from a variety of instruments, some being real and some being virtual.

Figure 5:
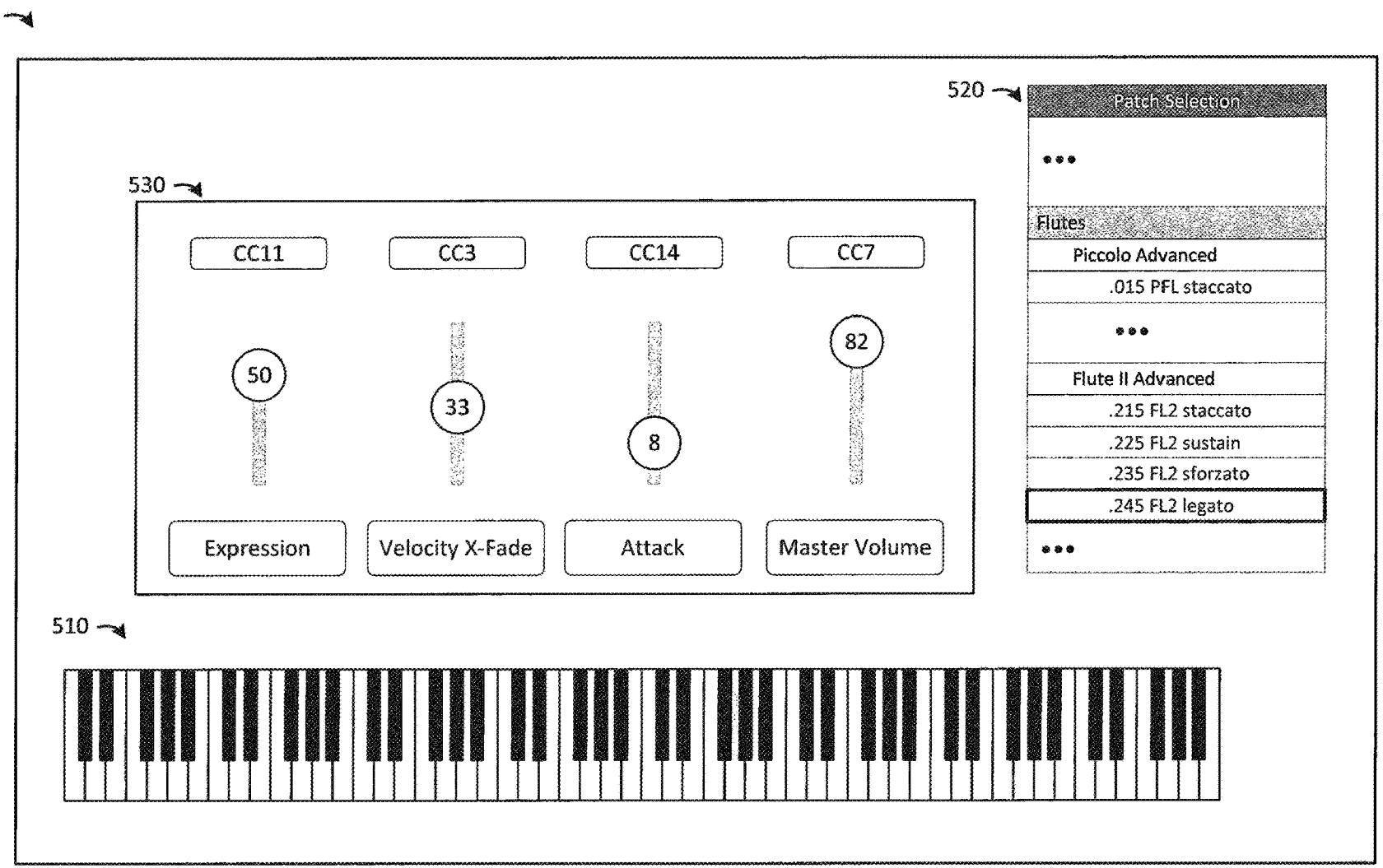
FIG. 5 depicts an illustrative graphical user interface for a sample library including dynamic controls, according to some embodiments.

FIG. 5 depicts an illustrative graphical user interface for a sample library including dynamic controls, according to some embodiments. Whilst embodiments described herein do not require the use of a graphical user interface to interact with a sample library, for purposes of illustration a representative interface is presented. As instructions are received by the sample library from a sequencer, instructions to play notes are represented by keyboard 510 shading keys to identify a played note. An instrument being played may be highlighted in the patch selection window 520. Controls that adjust the behavior of expressive playback of the notes are depicted with the sliders 530. In the example of FIG. 5, names of the controls are shown beneath a slider, with a MIDI control change channel number being shown above the slider.

Figure 6:
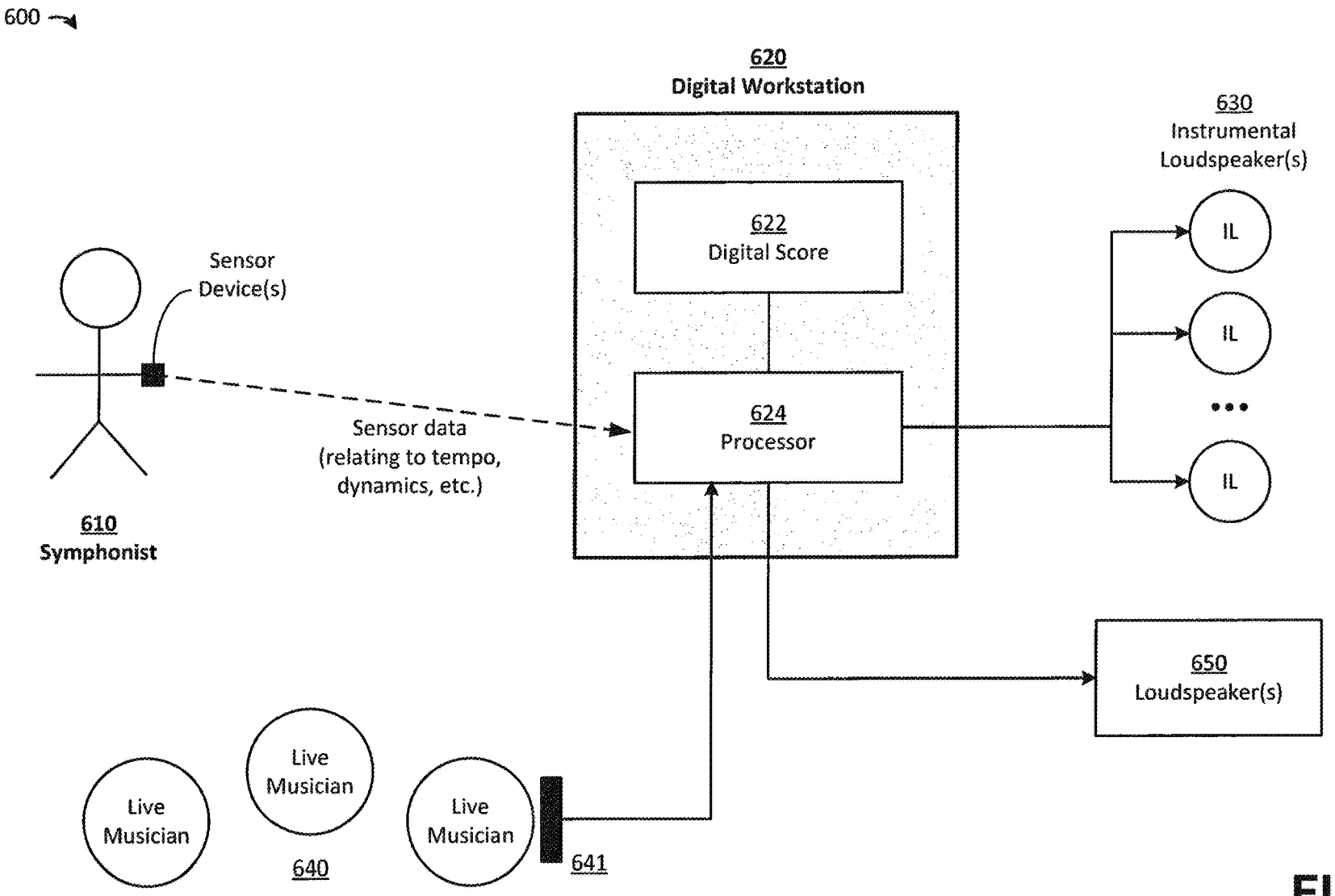
FIG. 6 is a schematic of a system for producing live music from live musicians in addition to virtual instruments with expressive behavior controlled by the live musicians, according to some embodiments.

FIG. 6 is a schematic of a system for producing live music from live musicians in addition to virtual instruments with expressive behavior controlled by the live musicians, according to some embodiments. System 600 includes a digital workstation 620 coupled to one or more instrumental loudspeakers 630 and loudspeakers 650. A digital musical score 622 stored by, or otherwise accessible to, the digital workstation may be executed by processor 624 which, for instance, may be executing a sequencer which executes the digital score. The production of music from the digital score may be produced according to control signals produced by the Symphonist 610 and output by one of more of the instrumental loudspeakers 630 and/or loudspeakers 650. In addition, sound captured from microphones placed near the live musicians 640, of which microphone 641 is one example, is provided to the processor 624 so that dynamical expression of virtual instruments of the digital score 622 may be controlled based on the captured sound via the techniques discussed above. Instrumental loudspeakers 630 are each an actual acoustic instrument configured with one or more transducers and an appropriate interface to enable an audio signal of the specific instrument to be propagated by the acoustic instrument when it is induced to do so by the transducer.

These combined components of system 600 produce the following effect. First, the live musicians 640 may music as conducted by the Symphonist in a conventional manner. Simultaneously, the digital workstation 620 produces the sound of virtual instruments through the instrumental loudspeaker(s) 630 and/or the loudspeaker(s) 650 as dictated by the digital score 622. Playback of the digital score is controlled in two ways: first, the tempo of the digital score may be controlled by the sensor data produced by the sensor device of the Symphonist, described further below; and second, the expressive behavior of the virtual instruments of the digital score is controlled by analyzing the sound from microphones such as microphone 641 to produce control parameter values as discussed above.

According to some embodiments, the Symphonist 610 may wear and/or hold one or more devices whose motion produces control data relating to tempo. As referred to herein, "tempo" refers at least to musical characteristics such as beat pacing, note onset timing, note duration, dynamical changes, and/or voice-leading, etc. As discussed above, the motions of the devices to produce such data may also be those of conventional movements of a conductor to convey tempo to live musicians. For instance, a baton comprising one or more accelerometers may provide the function of a conventional baton whilst producing sensor data that may be used to control production of music via the digital score 622. In general, devices that produce control data relating to tempo may include sensors whose motion generates data indicative of the motion, such as but not limited to, one or more accelerometers and/or gyroscopes.

According to some embodiments, devices that produce control data relating to tempo may comprise detectors external to the Symphonist that register the movements of the Symphonist, such as one or more cameras and/or other photodetectors that capture at least some aspects of the Symphonist's movements. Such external detectors may, in some use cases, register the Symphonist's movements at least in part by tracking the motion of a recognizable object held and/or worn by the Symphonist, such as a light, a barcode, etc.

As will be discussed further below, one important element of a conductor's 'beat' is the moment in the gesture when there is a change of angular direction. Most conductors place their beat so that, as a visual cue, it is located at the bottom of a vertical gesture, although many place it at the top of a vertical gesture ("vertical" refers to a direction that is generally perpendicular to the ground, or parallel to the force of gravity), and some outliers place the 'beat' elsewhere or nowhere. According to some embodiments, digital workstation 620 may be configured to identify a gesture conveying a beat based on sensor data received from the one or more devices of the Symphonist (whether held and/or worn by the Symphonist and/or whether external tracking devices), and to produce music according to the digital musical score 622 using a tempo implied by a plurality of identified beats (e.g., two sequential beats).

According to some embodiments, the Symphonist may wear and/or hold one or more devices whose motion produces control data relating to dynamics. As referred to herein, "dynamics" refers at least to musical characteristics such as variations in loudness, timbre, and/or intensity, etc.

According to some embodiments, the Symphonist may wear a device and/or hold a device that senses movement of a part of the Symphonist's body, such as a forearm or wrist, and produces pitch data corresponding to the movement. Said pitch data may include data representative of motion around any one or more axes (e.g., may include pitch, roll and/or yaw measurements). As an example, a device having one or more gyroscopes may be affixed to the underside of the Symphonist's forearm so that the motion of the forearm can be measured as the Symphonist raises and lowers his arm. Thereby, by raising and lowering the arm, control data relating to dynamics may be provided to the digital workstation 620. This may produce, for example, dynamic adjustment of the volume of music produced by the digital workstation by raising and lowering of the arm. The dynamics information may be independent of control information relating to tempo. Accordingly, a Symphonist could, for example, conduct using a baton providing control data defining tempo whilst also making additional motions that produce dynamics control data. Where motion around multiple axes is detected, the motion around the different axes may control different aspects of dynamics. For instance, pitch may control loudness while yaw may control timbre.

According to some embodiments, when detecting motion of a Symphonist by one or more sensor devices and generating control data relating to dynamics, the determination of a dynamical response may be based on relative, not absolute movement of the Symphonist. In some cases, the Symphonist may initiate a motion to alter the dynamics from a completely different position from a position where the Symphonist last altered the dynamics. For instance, the Symphonist may begin a gesture to cue for a reduction in volume with his arm raised to a first height, yet may have previously increased the volume to its current level by raising the arm to a height lower than the first height. If the control data were interpreted to adjust the volume based on the absolute height of the arm, the volume might be controlled to increase rapidly (because of the higher, first height being signaled) before the new gesture to reduce the volume were respected. As such, the digital workstation and/or sensor devices may produce and/or analyze control data based on relative motion. In some cases, this may involve a sensor that simply measures the difference in motion over time, in which case the digital workstation can simply analyze that difference to produce dynamics. In other cases, control data may be interpreted with a detected baseline value so that the difference in motion, not the absolute position, is interpreted.

According to some embodiments, a Symphonist may wear and/or hold a device that may be activated to enable and disable processing of control data by the digital workstation. For example, the Symphonist may wear a touch sensitive device, or a device with a button. In some embodiments, the Symphonist may wear three rings on the same hand, such as the second, third and fourth fingers. When the three fingers are held together, the three rings may form a connection that sends a 'connected' signal (e.g., wirelessly) to digital workstation 620. The Symphonist may, in other implementations, wear the rings on other fingers, or use other solutions to have a functional switch, but the gesture of bringing the three fingers together may be convenient and matches a conventional cue for dynamics used with live musicians. The 'connected' signal may enable the processing of control data by the digital workstation so that the Symphonist is able to enable and disable said processing, respectively, by moving the rings to touch each other or by moving the rings apart. In some embodiments, this process of enabling and disabling processing may be applied to only a subset of the control data provided to the digital workstation. For instance, the rings may enable and disable processing of control data relating to dynamics whilst processing of control data relating to tempo continues regardless of the state of the rings.

The inventor has recognized and appreciated that it may be desirable for a Symphonist to have control over the dynamics of both groups of instruments and individual instruments. Although there are many possible technical solutions that would enable the Symphonist to select a group of instruments and then control the dynamic behavior, it is desirable that the solution be as unobtrusive as possible, both visually and in terms of the demand on the Symphonist to do anything that would not be part of conventional expectations of a conductor.

According to some embodiments, the Symphonist may wear and/or hold one or more devices that allow for control of a subset of the instrumental loudspeakers 630. The devices, when operated by the Symphonist, may provide a signal to the digital workstation that a particular subset of the instrumental loudspeakers is to instructed separately. Subsequent control signals may be directed exclusively to those instrumental loudspeakers. In some cases, the type of control signals so limited may be a subset of those provided by the Symphonist; for instance, by selecting a subset of the instrumental loudspeakers, tempo control data may be applied to music output by all of the instrumental loudspeakers, whilst dynamics control data may be applied only to music output to the selected subset. Devices suitable for control of a subset of the instrumental loudspeakers include devices with eye-tracking capabilities, such as eye-tracking glasses. When the Symphonist looks in a particular direction, for example, this may communicate to the system that instruments in a particular group (e.g., located in that direction with respect to the Symphonist) are to be controlled separately.

According to some embodiments, the digital workstation may provide feedback to the Symphonist that a subset of instrumental loudspeakers has been selected via visual cues, such as by a light or set of lights associated with a subset of instrumental loudspeakers that are lit by the digital workstation, and/or via a message on a display. In some cases, such visual cues may be visible only to the Symphonist, e.g., the visual cues may be displayed to an augmented reality (AG) device worn by the Symphonist and/or may be produced in a non-visible wavelength of light (e.g., infrared) made visible by a device worn by the Symphonist.

According to some embodiments, the musical score 622 may comprise MIDI (Musical Instrument Digital Interface) instructions and/or instructions defined by some other protocol for specifying a sequence of sounds. The sounds may include prerecorded audio, sampled sounds, and/or synthesised sounds. Commonly, digital score software may be referred to as a 'Sequencer', a DAW (Digital Audio Workstation), or a Notation package. There are differences between these three types of software: a sequencer is intended mostly for MIDI scores, a notation package can be regarded as a word-processor for music (intended to be printed and handed to musicians), and a DAW is mostly for audio processing, although most recent DAWs include MIDI capabilities, and few dedicated MIDI sequencers remain in use. According to some embodiments, the digital workstation 620 may comprise a Digital Audio Workstation.

Irrespective of how the musical score of digital workstation 620 is implemented, the workstation is configured to produce acoustic data at a rate defined by a beat pattern of the musical score, an example of which is discussed below. The acoustic data may comprise analog audio signals (e.g., as would be provided to a conventional loudspeaker), digital audio signals (e.g., encoded audio in any suitable lossy or lossless audio format, such as AAC or MP3), and/or data configured to control a transducer of an instrumental loudspeaker to produce desired sound (examples of which are discussed below).

According to some embodiments, the musical score may comprise a plurality of beat points, each denoting a particular location in the musical score. These beat points may be periodically placed within the score, although they may also exhibit non-periodic placements. Control information received by the digital workstation relating to tempo is then used to trigger each beat point in turn. For instance, a spike in acceleration produced by an accelerometer-equipped baton may denote a beat as communicated by the Symphonist, and this may trigger a beat point in the score.

According to some embodiments, control data received from one or more devices by the digital workstation relating to tempo may indicate triggering of a beat point or may comprise sensor data that may be analyzed by the digital workstation to identify triggering of a beat point. That is, which particular device determines triggering of a beat point is not limited to the digital workstation, as any suitable device may determine triggering of a beat point based on sensor data. In preferred use cases, however, sensor devices may stream data to the digital workstation, which analyzes the data as it is received to detect when, and if, a beat point has been triggered.

According to some embodiments, in periods between beat points, the digital workstation may select an appropriate tempo and produce music according to the score at this tempo. This tempo may be selected based on, for example, the duration between the triggering of the previous two, three, etc. beat points. In some use cases, the tempo may be determined by fitting a curve to the timing distribution of beat points to detect whether the tempo is speeding up or slowing down. Once a tempo is selected by the digital workstation, the acoustic data is produced according to this tempo at least until a new determination of tempo is made. In some embodiments, a tempo is determined when every beat point is triggered based on the relative timing of that beat point to one or more of the previously received beat points.

According to some embodiments, control data received by the digital workstation during periods between beat points may provide additional information on tempo, and the digital workstation may, in some cases, adjust the tempo accordingly even though no new beat point has been triggered. For example, a Symphonist's baton moving up and down repeatedly may trigger a beat point due to quick motion at the bottom of the movement, though may also produce identifiable accelerometer data at the top of the movement. This "secondary" beat may be identified by the digital workstation and, based on the time between the primary beat point and the secondary beat, the digital workstation may determine whether to adjust the tempo. For example, if the time between the primary beat point and the secondary beat is less than half that of the time between the last two primary beat points, this suggests the tempo is speeding up. Similarly, if the time between the primary beat point and the secondary beat is greater than half that of the time between the last two primary beat points, this suggests the tempo is slowing down. Such information may be used between beat points to modify the current tempo at which acoustic data is being output by the digital workstation.

According to some embodiments, system 600 may include one or more devices (not shown in FIG. 6) for communicating tempo to live musicians. This communication may occur in addition to the conveyance of tempo by the Symphonist. The devices for communicating tempo to the live musicians may include devices that produce visual, audible and/or haptic feedback to the musicians. As examples of visual feedback, tempo in the form of a beat and/or in the form of music to be accompanied may be communicated to musicians by a flashing light (e.g., fixed to music-stands) and/or by a visual cue to augmented-reality glasses worn by the musicians. As examples of haptic feedback, tempo in the form of a beat may be communicated to musicians by a physically perceived vibration, which could, for instance, be effected through bone induction via a transducer placed in a suitable location, such as behind the ear, or built into chairs on which the musicians sit.

According to some embodiments, the digital workstation 620 may comprise one or more communication interfaces, which may include any suitable wired and/or wireless interfaces, for receiving sensor data from devices worn and/or held by the Symphonist 610 and/or from other devices capturing position or motion information of the Symphonist; and for transmitting acoustic data to the instrumental loudspeakers 630. In some cases, a device worn or held by the Symphonist may transmit control data to the digital workstation via a wireless protocol such as Bluetooth®.

As discussed above, instrumental loudspeakers 630 comprise actual acoustic instruments configured with one or more transducers and an appropriate interface to enable an audio signal of the specific instrument to be propagated by the acoustic instrument when it is induced to do so by the transducer. Each instrument class may have a different method to interface the transducer with the instrument, and in some cases, the instruments may be complimented with bending-wave resonating panel loudspeakers. According to some embodiments, a suitable transducer includes a so-called "DMD-type" transducer (such as described in U.S. Pat. No. 9,130,445, titled "Electromechanical Transducer with Non-Circular Voice Coil," which is hereby incorporated by reference in its entirety), but could alternatively be a standard voice-coil design. The instrumental loudspeakers may include, for example, numerous stringed and brass instruments in addition to a "vocal" loudspeaker designed to mimic the human voice. Illustrative examples of such devices are described in further detail below. As discussed above, acoustic data received by an instrumental loudspeaker may comprise analog audio, digital audio signals, and/or data configured to control a transducer of the instrumental loudspeaker.

In some embodiments, loudspeaker(s) 650 may include one or more virtual acoustic loudspeakers to adjust the acoustics of the space in which system 600 is deployed. Even with a combination of live musicians and instrumental loudspeakers, some performance spaces may nonetheless have inferior acoustics for orchestral music. One or more virtual acoustic loudspeakers may be placed within the performance space to control the acoustics to be, for example, more like that of a larger concert hall.

In particular, the inventor has recognized and appreciated that capturing ambient sound from a listening environment and rebroadcasting the ambient sound with added reverb through an appropriate sound radiator (e.g., a diffuse radiator loudspeaker) can cause a listener to become immersed in a presented acoustic environment by effectively altering the reverberance of the listening environment. Sounds originating from within the environment may be captured by one or more microphones (e.g., omni-directional microphones) and audio may thereafter be produced from a suitable loudspeaker within the environment to supplement the sounds and to give the effect of those sounds reverberating through the environment differently than they would otherwise.

According to some embodiments, a virtual acoustic loudspeaker may include one or more microphones and may rebroadcast the ambient sound of the performance space in which system 600 is located whilst adding reverb to the sound. Since the ambient sound may include music produced by one or more live musicians and one or more instrumental loudspeakers, the music produced by the system may be propagated in the performance space in a manner more like that of a desired performance space. This can be used, for example, to make sounds produced in a small room sound more like those same sounds were they produced in a concert hall.

According to some embodiments, virtual acoustic loudspeaker 650 may comprise one or more diffuse radiator loudspeakers. The use of diffuse radiator loudspeakers may provide numerous advantages over systems that use conventional direct radiator loudspeakers. Radiation may be produced from a diffuse radiator loudspeaker at multiple points on a panel, thereby producing dispersed, and in some cases, incoherent sound radiation. Accordingly, one panel loudspeaker may effectively provide multiple point sources that are decorrelated with each other.

Virtual acoustic loudspeakers may, according to some embodiments, include a microphone configured to capture ambient sound within a listening space; a diffuse radiator loudspeaker configured to produce incoherent sound waves; and/or a reverberation processing unit configured to apply reverberation to at least a portion of ambient sound captured by the at least one microphone, thereby producing modified sound, and output the modified sound into the listening space via the diffuse radiator loudspeaker. For instance, virtual acoustic loudspeakers within a Symphonova system may incorporate any suitable loudspeaker configuration as described in International Patent Publication No. WO2016042410, titled "Techniques for Acoustic Reverberance Control and Related Systems and Methods," which is hereby incorporated by reference in its entirety. Virtual Acoustics loudspeakers may also be referred to herein as acoustic panel loudspeakers or diffuse radiator loudspeakers.

According to some embodiments, microphone 641 may capture sound produced by a musician's instrument and transmit the sound to the digital workstation. In some embodiments, one or more of the live musicians 640 may play an instrument coupled to both an acoustic microphone and a contact microphone. These microphones may be provided as a single combination microphone (e.g., in the same housing). Such a combination microphone may enable a method of receiving both the acoustic sound 'noise' of the instrument, as well as the resonant behavior of the instrument's body. As will be described below, an contact microphone may be used in the case of a string instrument to capture sounds suitable for production via a string instrumental loudspeaker. The contact microphone may transduce the behavior of the instrument, and not the sound of the instrument, whilst the physical behavior of the musician's instrument is then processed through the digital workstation, and output to a transducer that induces the same behavior in the body of the instrumental loudspeaker.

It will be noted that, in some cases to be described further below, sound captured from a live musician such as by a microphone or other transducer attached to, or in close proximity to, their instrument may be captured and output from one or more instrumental loudspeakers. While this audio pathway is not illustrated in FIG. 6 for clarity, it will be appreciated that nothing about the illustrative system 600 is incompatible with this optional way to produce additional sound.

It should be appreciated that, in the example of FIG. 6, it is not a requirement that the Symphonist be located in the same physical location as any one or more other elements of system 600, and in general the described elements of FIG. 6 may be located in any number of different locations. For instance, the Symphonist may remotely conduct live musicians in another location; or a Symphonist may conduct live musicians in their location whilst instrumental loudspeakers producing sound are located in a different location.

Figure 7:
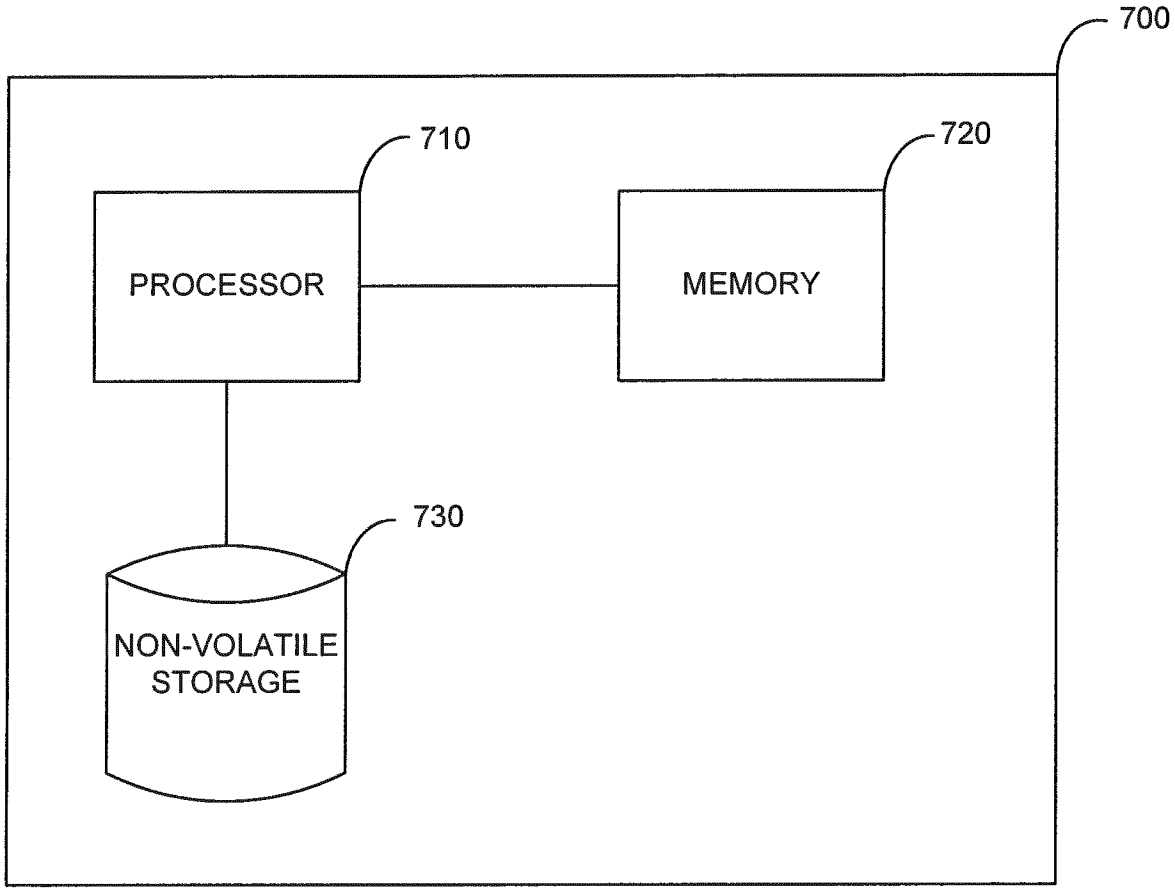
FIG. 7 illustrates an example of a computing system environment on which aspects of the invention may be implemented.

An illustrative implementation of a computer system 700 that may be used to control the expressive behavior of a virtual instrument is shown in FIG. 7. The computer system 700 may include one or more processors 710 and one or more non-transitory computer-readable storage media (e.g., memory 720 and one or more non-volatile storage media 730). The processor 710 may control writing data to and reading data from the memory 720 and the non-volatile storage device 730 in any suitable manner, as the aspects of the invention described herein are not limited in this respect. To perform functionality and/or techniques described herein, the processor 710 may execute one or more instructions stored in one or more computer-readable storage media (e.g., the memory 720, storage media, etc.), which may serve as non-transitory computer-readable storage media storing instructions for execution by the processor 710.

In connection with techniques described herein, code used to, for example, determine values of expression parameters, determine values of control parameters, control playback of a digital score, control playback of samples, produce control messages, etc. may be stored on one or more computer-readable storage media of computer system 700. Processor 710 may execute any such code to provide any techniques for production of music as described herein. Any other software, programs or instructions described herein may also be stored and executed by computer system 700. It will be appreciated that computer code may be applied to any aspects of methods and techniques described herein. For example, computer code may be applied to interact with an operating system to produce sound through conventional operating system audio processes.

The various methods or processes outlined herein may be coded as software that is executable on one or more processors that employ any one of a variety of operating systems or platforms. Additionally, such software may be written using any of numerous suitable programming languages and/or programming or scripting tools, and also may be compiled as executable machine language code or intermediate code that is executed on a virtual machine or a suitable framework.

In this respect, various inventive concepts may be embodied as at least one non-transitory computer readable storage medium (e.g., a computer memory, one or more floppy discs, compact discs, optical discs, magnetic tapes, flash memories, circuit configurations in Field Programmable Gate Arrays or other semiconductor devices, etc.) encoded with one or more programs that, when executed on one or more computers or other processors, implement the various embodiments of the present invention. The non-transitory computer-readable medium or media may be transportable, such that the program or programs stored thereon may be loaded onto any computer resource to implement various aspects of the present invention as discussed above.

The terms "program," "software," and/or "application" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion among different computers or processors to implement various aspects of the present invention.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments.

Also, data structures may be stored in non-transitory computer-readable storage media in any suitable form. Data structures may have fields that are related through location in the data structure. Such relationships may likewise be achieved by assigning storage for the fields with locations in a non-transitory computer-readable medium that convey relationship between the fields. However, any suitable mechanism may be used to establish relationships among information in fields of a data structure, including through the use of pointers, tags or other mechanisms that establish relationships among data elements.

Various inventive concepts may be embodied as one or more methods, of which examples have been provided. The acts performed as part of a method may be ordered in any suitable way. Accordingly, embodiments may be constructed in which acts are performed in an order different than illustrated, which may include performing some acts simultaneously, even though shown as sequential acts in illustrative embodiments.

The indefinite articles "a" and "an," as used herein in the specification and in the claims, unless clearly indicated to the contrary, should be understood to mean "at least one." As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. A computer-implemented method of controlling the expressive behavior of a virtual musical instrument, the method comprising:

obtaining an audio recording of a live musician playing an instrument; and generating, using at least one processor, at least part of a digital score representing audio of a virtual instrument having dynamic expression based on the audio recording, said generating comprising:

determining, for a first time position within the audio recording and based on the audio recording, a first value of an expression parameter, wherein the expression parameter is indicative of dynamic expression of the live musician;

generating a first value of a control parameter based at least in part on the determined first value of the expression parameter, wherein the control parameter controls one or more aspects of the playback of audio samples for the virtual instrument;

determining, for a second time position within the audio recording and based on the audio recording, a second value of the expression parameter; and generating a second value of the control parameter based at least in part on the determined second value of the expression parameter.

2. The method of claim 1, further comprising:

storing the first value of the control parameter within the digital score at one or more time positions based on the first time position; and storing the second value of the control parameter within the digital score at one or more time positions based on the second time position.

3. The method of claim 1, further comprising:

generating a first control message for the first time position within the audio recording, the first control message comprising an indication of the control parameter and an indication of the first value of the control parameter; and generating a second control message for the second time position within the audio recording, the second control message comprising an indication of the control parameter and an indication of the second value of the control parameter.

4. The method of claim 3, further comprising providing the first control message and the second control message to a sample library.

5. The method of claim 4, further comprising:

selecting, by the sample library from a plurality of audio samples, a first audio sample and a first value for at least one playback control of the first audio sample based at least in part on the first control message; and selecting, by the sample library from the plurality of audio samples, a second audio sample and a second value for the at least one playback control, different from the first value, of the second audio sample based at least in part on the second control message.

6. The method of claim 1, wherein the audio recording of the live musician is obtained as a stream of audio data and wherein the at least part of the digital score is generated in real-time based on the stream of audio data.

7. The method of claim 1, wherein generating the at least part of the digital score is further based on sensor data generated by the live musician playing the instrument, the sensor data being produced concurrently with the audio recording.

8. The method of claim 1, wherein determining the first value of an expression parameter comprises determining a peak amplitude of the audio recording at the first time position.

9. The method of claim 8, wherein determining the first value of an expression parameter comprises determining a predetermined mixture of the peak amplitude of the audio recording at the first time position and a root mean square of the peak amplitude of the audio recording at the first time position.

10. The method of claim 1, wherein generating the first value of the control parameter based at least in part on the determined first value of the expression parameter comprises scaling the first value of the expression parameter to an integer value within a predetermined range.

11. The method of claim 10, wherein the predetermined range is between 0 and 127.

12. The method of claim 1, wherein generating the first value of the expression parameter comprises determining a centroid of a frequency spectrum of the audio recording at the first time position.

13. The method of claim 12, wherein generating the first value of the expression parameter comprises applying an offset to a measurement of the audio recording, the offset being selected based at least in part on a frequency value of the determined centroid.

14. A non-transitory computer-readable medium comprising instructions that, when executed by at least one processor, perform a method of controlling the expressive behavior of a virtual musical instrument, the method comprising:

obtaining an audio recording of a live musician playing an instrument; and generating, using at least one processor, at least part of a digital score representing audio of a virtual instrument having dynamic expression based on the audio recording, said generating comprising:

determining, for a first time position within the audio recording and based on the audio recording, a first value of an expression parameter, wherein the expression parameter is indicative of dynamic expression of the live musician;

generating a first value of a control parameter based at least in part on the determined first value of the expression parameter, wherein the control parameter controls one or more aspects of the playback of audio samples for the virtual instrument;

determining, for a second time position within the audio recording and based on the audio recording, a second value of the expression parameter; and generating a second value of the control parameter based at least in part on the determined second value of the expression parameter.

15. The non-transitory computer-readable medium of claim 14, further comprising:

storing the first value of the control parameter within the digital score at one or more time positions based on the first time position; and storing the second value of the control parameter within the digital score at one or more time positions based on the second time position.

16. The non-transitory computer-readable medium of claim 14, further comprising:

generating a first control message for the first time position within the audio recording, the first control message comprising an indication of the control parameter and an indication of the first value of the control parameter; and generating a second control message for the second time position within the audio recording, the second control message comprising an indication of the control parameter and an indication of the second value of the control parameter.

17. The non-transitory computer-readable medium of claim 16, further comprising providing the first control message and the second control message to a sample library.

18. The non-transitory computer-readable medium of claim 17, further comprising:

selecting, by the sample library from a plurality of audio samples, a first audio sample and a first value for at least one playback control of the first audio sample based at least in part on the first control message; and selecting, by the sample library from the plurality of audio samples, a second audio sample and a second value for the at least one playback control, different from the first value, of the second audio sample based at least in part on the second control message.

19. The non-transitory computer-readable medium of claim 14, wherein the audio recording of the live musician is obtained as a stream of audio data and wherein the at least part of the digital score is generated in real-time based on the stream of audio data.

20. The non-transitory computer-readable medium of claim 14, wherein generating the at least part of the digital score is further based on sensor data generated by the live musician playing the instrument, the sensor data being produced concurrently with the audio recording.

* * * * *